United States Patent [19]

Vayda

[11] 3,966,167

[45] June 29, 1976

[54] SIDEBOARD CONSTRUCTION

[75] Inventor: Pierre A. Vayda, Burlington, Canada

[73] Assignee: Exothermic Company of Canada Limited, Hamilton, Canada

[22] Filed: May 6, 1975

[21] Appl. No.: 574,852

[52] U.S. Cl. ..... 249/198; 249/202; 29/432; 29/458; 29/526

[51] Int. Cl.[2] ..... B22D 7/10

[58] Field of Search ..... 249/197, 198, 199, 200, 249/201, 202; 29/432, 458, 526

[56] References Cited

UNITED STATES PATENTS 3,506,236 4/1970 Brawner et al. ..... 249/202

FOREIGN PATENTS OR APPLICATIONS 1,261,633 2/1968 Germany ..... 249/202

*Primary Examiner*—Travis S. McGehee

*Attorney, Agent, or Firm*—Sim & McBurney

[57] ABSTRACT

This invention provides a novel sideboard construction, which includes at least one hanger rod of which a portion is embedded in the material of the sideboard, the sideboard also having a plate member equipped with a non-circular opening through which the hanger rod passes. The hanger rod section is also non-circular in the region of the plate member, and the relative dimensions of these two are such that the rod is rotatable within the opening between a first position in which it binds against edge portions of the opening, and a second position in which it does not so bind. The rod in the second position can be moved lengthwise through the opening, and in the first position is "jammed" or caught in the opening, and thus capable of supporting the weight of the sideboard as the latter is suspended inside the top of an open-topped metal ingot mold. The material of the rod is softer than the material defining the opening.

13 Claims, 10 Drawing Figures

SIDEBOARD CONSTRUCTION

This invention relates generally to the construction of sideboards for use with an open-topped metal ingot mold, of the kind utilized for casting steel ingots.

In the pouring of steel ingots, an open-topped ingot mold is utilized, which usually defines a substantially rectangular inner cavity with rounded corners, and which ordinarily includes a flat top edge portion. Sideboards are utilized within the upper inner portion of the open-topped ingot mold for the purpose of insulating the upper layers of the hot metal, and sometimes to add additional heat to the hot metal in the upper portion thereof. The sideboards may typically be manufactured as four components which fit together to completely surround the upper inner portion of the open-topped ingot mold, and are ordinarily made of heat-insulative material, which may also be exothermic, i.e. may undergo an exothermic reaction when contacted by the hot metal, thereby adding additional heat to the hot metal. The reason behind the desire to keep the metal in the upper portion of the ingot mold hot, and/or to add additional heat to the metal at this point, relates to the phenomenon of shrinkage and contraction which takes place in the metal as it solidifies within the ingot mold. It is a characteristic of most metals, particularly steel, that contraction takes place during solidification, and if the solidification takes place first at the upper open surface of the metal, there will be a serious risk of voids and cavities forming in the mold, which may give problems later during the rolling process. In order to circumvent these problems, sideboards are used. The presence of the sideboards around the upper inner portion of the ingot mold cavity ensures that the metal in the top layers, after pouring, will remain molten, and that solidification will take place first in the lower parts of the mold. In this manner, a molten "pool" of metal is available in the upper portion of the ingot mold to supply additional molten metal, and thus to compensate for shrinkage. The same reason lies behind the provision of side-boards which undergo exothermic reactions when contacted by the molten metal. The primary purpose is again to keep the metal in the molten state at the upper portion of the ingot mold, thereby to provide a pool of hot metal to compensate for shrinkage lower down in the ingot as it solidifies.

In general configuration, a sideboard for an open-topped metal ingot mold usually has one surface which conforms substantially to the inner face of the ingot mold, this being the "outer" face of the sideboard, and the sideboard also has an inner face opposed to this "outer" face. It is typical to find both of these faces parallel. The side edge portions of the sideboard may be planar, or any suitable shape depending upon the way in which the plurality of sideboards are intended to interlock together in order to fully surround the hot metal at the upper portion of the ingot mold. Typically also, the sideboard includes an inwardly and upwardly sloping lower surface which thus forms a kind of wedge with the sideboard face intended to be located against the inside wall of the ingot mold. This upwardly and inwardly oblique bottom face is provided to ensure that the molten metal, as it rises upwardly within the metal ingot mold during pouring, will not creep in between the sideboard and the ingot mold, and "float" the sideboard upwardly away from its position against the wall of the mold.

The prior art contains several means and instrumentalities for positioning sideboards within ingot molds, and some proposals have been put forth to provide adjustability in the vertical direction with respect to the ingot mold, so that the operator may position the sideboards at the most advantageous position within the ingot mold, as determined by the maximum height to which the molten metal rises within the mold. Generally speaking, it is a desirable feature for the sideboards to be adjustable to some extent, because this permits greater versatility in terms of the size of ingot being poured and solidified within a given ingot mold. One of the drawbacks with the prior art approaches to adjustability for sideboards relates to the fact that most arrangements of this type previously proposed have permitted only a limited number of discrete vertical positions of the sideboard within the mold, there being no other, intermediate choices available.

In view of the foregoing drawback of the prior art proposals, it is an aspect of this invention to provide a sideboard construction which may be hung and supported within the top of an open-topped metal ingot mold at a vertical position which may be selected virtually at will, and which may be adjusted in very fine gradients, without any theoretical limitation on this adjustability.

Accordingly, this invention provides, for use with an open-topped metal ingot mold: a sideboard comprising a body portion, a hanger rod of which part extends through said body portion, and a plate member embedded within the body portion, the plate member being oriented substantially normally to the hanger rod and having a non-circular opening with a least dimension measured in one directon and a greatest dimension measured in another direction, the rod passing through said opening and having a non-circular section at least in the region of said opening, said rod being rotatable within said opening between a first position in which it binds against edge portions of the opening and a second position in which it does not so bind, whereby the rod in said second position can be moved lengthwise through said opening, the material of the rod being softer than the material defining the opening, another part of the rod extending out of the body portion and having means for hanging the sideboard from the ingot mold.

Two embodiments of this invention are illustrated in the accompanying drawings, in which like numerals denote like parts throughout the several views, and in which.

Figure 1:
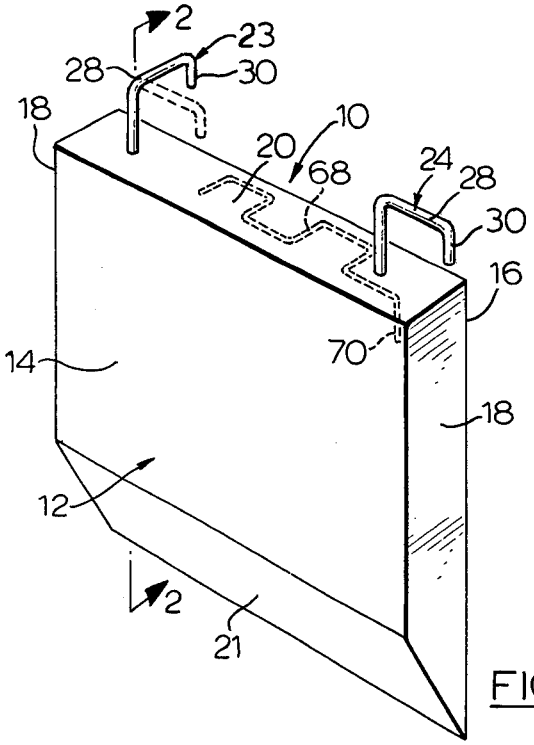
FIG. 1 is a perspective view of a sideboard constructed in accordance with this invention.

Attention is first directed to FIG. 1, in which a sideboard shown generally at 10 is seen to include a body portion 12 having an inner face 14, an outer face 16, (shown in FIG. 2), two side faces 18, a top face 20, and a bottom oblique face 21. It will be seen that the oblique face 21 and the outer face 16 defined between them a wedge-shaped corner portion 22.

Embedded in the body portion 12 of the sideboard 10 are two hanger rods 23 and 24, each of which includes an elongated main part 26 actually buried within the body portion 12, and a further part 28 extending substantially perpendicularly to the main part 26, and having on its end remote from the main part a reversely directed end portion 30. Thus, each hanger rod 23, 24 is shaped generally as the letter "J", as paticularly well seen in FIG. 2.

Figure 2:
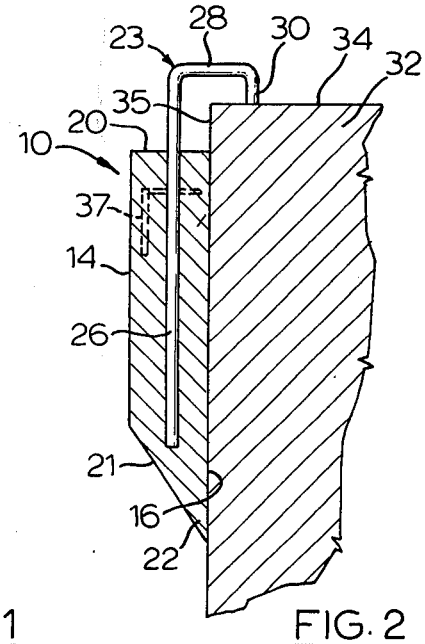
FIG. 2 is a sectional view taken at the line 2—2 in FIG. 1, and including a portion of the metal ingot mold.

Also illustrated in FIG. 2 is a portion of a wall of a metal ingot mold 32, having an upper edge 34, against which the end portions 30 of the hanger rods 23, 24 are adapted to rest, thereby supporting the sideboard 10 against the inside face 35 of the ingot mold 32.

Figure 3:
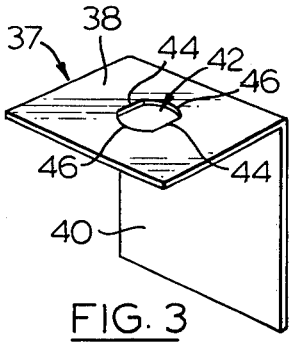
FIG. 3 is a perspective view of one component of the sideboard shown in FIG. 1, drawn to a larger scale.

Also embedded within the body portion 12 of the sideboard 10 is a locking element 37 shown best in FIG. 3, and appearing in section in FIG. 2. The locking element 37 includes, in the embodiment shown, a plate member 38 and an anchoring member 40 which are integral with each other, these being merely two portions of a sheet steel plate of rectangular configuration which has been bent into the shape of the letter "L". The locking element 37 is oriented within the body portion 12 such that the plate member 38 is oriented substantially normally or perpendicular to the elongated main part 26 of the hanger rods 23, 24. It will be understood that there are two such locking elements 37 buried within the body portion 12 shown in FIG. 1, one locking element for each of the hanger rods.

The plate member 38 of each locking element 37 has a non-circular opening 42 through which the elongated main part 26 of the respective hanger rods 23, 24 passes.

In the embodiments illustrated in the drawings, the openings 42 have the general shape of a circle from which two antipodal, identical segments have been removed, thereby providing a shape defined by two straight edges 44, and two arcuate edges 46. So shaped, the distance between the two straight edges 44 will be smaller than the diametral distance between the two arcuate edges 46, whereby the non-circular opening 42 will have a least dimension measured in one direction (between the straight edges 44) and a greatest dimension measured in another or different direction (between the two arcuate edges 46).

Figure 4:
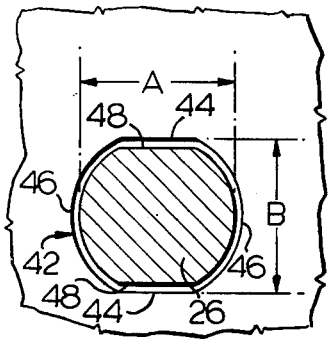
FIGS. 4, 5 and 6 are plan/section views of one embodiment, and show a portion of the component of FIG. 3 in plan and the rod in section, illustrating three sequential positions of these two components relative to each other.
Figure 5:
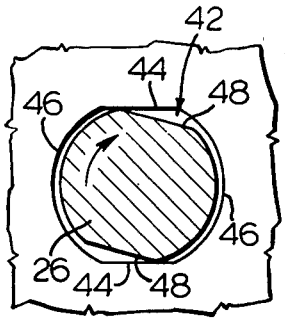
Figure 6:
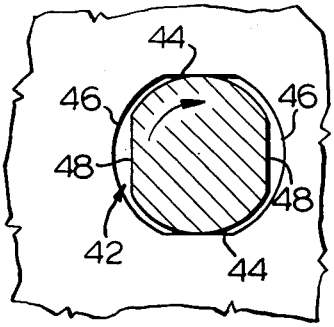

The elongated main part 26 of the respective hanger rods 23, 24 which passes through the opening 42 also has a non-circular section, at least in the region of the opening 42. The sectional shape of the first embodiment of the rod is best seen in FIGS. 4, 5 and 6, to which attention is now directed. The non-circular opening 42 is illustrated around the hanger rod, the latter being shown hatched. The opening 42 has been illustrated within a broken away part of the plate member 38, this being represented by the irregular edge surrounding the opening 42. Within the opening 42, the elongated main part 26 of the respective hanger rod is seen to include two straight edges 48, representing "flats" at antipodal locations lengthwise of the elongated main part 26 of the respective hanger rod, the remainder of the section of the hanger rod in the area of the opening 42 being of circular or arcuate configuration.

It is an essential feature of this invention that each of the hanger rods 23, 24 be rotatable within the respective opening 42 between a first position in which the outer surface of the respective hanger rod binds against edge portions of the opening 42, and a second position in which it does not so bind, whereby the rod in the second position can be moved lengthwise through the opening 42. In order for this feature to be present, certain relations must exist between at least some of the dimensions of the rod and hole respectively. In FIG. 4, the dimension A is the true diameter of the elongated main part 26 of the respective hanger rod, taken diametrally c8 between the circular edges of the section of the rod, and ignoring the "flats" represented in FIG. 4 by the straight edges 48. The dimension B in FIG. 4 is the perpendicular dimension between the two straight edges 44 of the non-circular opening 42 in the plate member 38. For the configurations of the rod and the opening shown in FIG. 4, the necessary binding between the rod and the portions of the plate member 38 defining the opening 42 can take place so long as the dimension B is slightly smaller than the dimension A. With this dimensional relationship, the rod may be rotated (in either direction) away from the relative orientation shown in FIG. 4, until the circular or arcuate edge portions of the hanger rod come into binding contact with the two straight edges 44 of the opening 42. FIG. 5 shows a first incremental rotation of the hanger rod with respect to the opening 42, the rod having reached a point where binding mechanical interference between the rod and the part of the plate member 38 defining the opening 42 is about to take place. FIG. 6 shows the rod rotated a full 90° from the orientation of FIG. 4, it being understood that binding engagement between the rod and the plate member 38 defining the opening 42 has taken place over the full angle from the orientation of FIG. 5 to that of FIG. 6.

It will be understood that, if it is desired to decrease the arc over which binding or mechanical interference takes place between the rod and the opening, it is simply necessary to increase the size of the "flats" of the elongated main part 26 of the respective hanger rods 23, 24 thereby bringing the two straight edges 48 closer together in FIG. 4.

Figure 7:
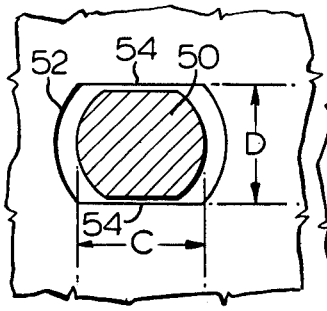
FIGS. 7 and 8 illustrate a further embodiment of this invention, and correspond in terms of sequence to FIGS. 4 and 6.
Figure 8:
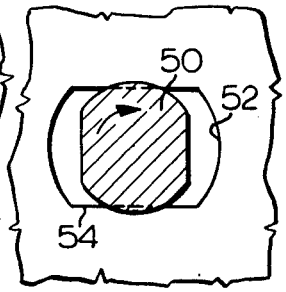

It will be noted in FIGS. 4 – 6 that the diametral dimension of the elongated main part 26 of the respective hanger rod is shown to be only slightly smaller than the diametral dimension of the opening 42. This is not an essential feature. The second embodiment of the invention, illustrated in FIGS. 7 and 8, shows that a rod having a considerably smaller diameter than that of the opening can nonetheless function satisfactorily, provided that the critical dimensional relationships are adhered to. In FIGS. 7 and 8, the rod is shown by the numeral 50, and the opening is identified by the numeral 52. The straight edges 54 are more pronounced in the second embodiment of this invention, and the dimension between them, identified by the letter D, is again smaller than the diametral dimension of the rod 50, identified by the numeral C. The difference between the dimensions C and D is greater than the difference for dimensions A and B. In FIG. 8, which shows the rod 50 rotated 90° from the orientation of FIG. 7, it is quite clear that a significant degree of mechanical interference exists between the rod 50 and the opening 52. The requisite binding or mechanical interference between the two items has of course taken place over at least a portion of the arcuate rotational movement of the rod from the position shown in FIG. 7 to that shown in FIG. 8.

It is considered essential to this invention that the material from which the rods 23, 24 is made be softer than the material defining the opening 42, such that when the binding or mechanical interference takes place, the edge of the opening cuts into the rod, rather than being worn away by the rod. The edge of the opening cuts more deeply into the rod for the embodiment shown in FIGS. 7 and 8 than it does for the embodiment of FIGS. 4 – 6, but the effect is the same. If on the contrary the edge of the opening were to be worn away by the rotation of the rod, which would take place if the rod were harder than the material of the plate member 38, then the "least" dimension of the non-circular opening would gradually be widened or increased to the point where no binding or mechanical interference any longer took place between the rod and the opening.

Satisfactory results have been obtained with a plate member made of sheet steel with a thickness in the range from about .020 to about .026 in., and a cabon content in the range from about 0.30% to about 0.50%, in conjunction with a hanger rod also of steel, and with a carbon content in the range from about 0.10% to about 0.20%. A hanger rod with a nominal diameter of about one-quarter inch has proven satisfactory.

As to the extent of the mechanical interference (binding) between the hanger rod and the opening, this will be a function of the relative hardness of the binding members. However, a mechanical interference in the range from about 0.02 in. to about 0.05 in. has been found satisfactory. In other words, if the largest dimension of the non-circular section of the hanger rod is larger than the least dimension of the non-circular opening by an amount in the latter range, the result is satisfactory.

Returning to FIG. 3, taken in conjunction with FIG. 2, it will be noted that the anchoring member 40, forming an integral part of the locking element 37, is oriented substantially perpendicularly to the plate member 38, and extends substantially parallel to the elongated main part 26 of the respective hanger rod 23, 24. The primary function served by the anchoring member 40 is that of resisting any tendency for the plate member 38 to swivel within the body portion 12 as a result of torque applied thereto through rotation of the hanger rod from the position represented by FIGS. 4 and 7 to the position represented in FIGS. 6 and 8. It will be understood, of course, that as the hanger rod is rotated through the arc over which binding or mechanical interference takes place, a greater or lesser torque will be transmitted from the hanger rod to the plate member 38, depending upon the extent of the interference between the rod and the plate member. It is for this reason that the dimension associated with the mechanical interference between the rod and the plate member should not be excessively large. The anchoring member 40 simply assures the strongest possible grip and interlock between the plate member 38 and the body portion 12, for the purpose of resisting the torque which naturally will be applied to the plate member 38 as the hanger rod is made to swivel.

It is considered that, so long as the mechanical interference dimension between the hanger rod and the non-circular opening is made small enough, it should be possible to dispense with the anchoring member 40. Also, the anchoring member 40 could be replaced by a portion of a somewhat different configuration, or more than one portion, these portions being attached to the plate member 38. For example, one anchoring portion might extend downwardly from one edge of the plate member 38, and another anchoring portion might extend upwardly from an opposite or adjacent edge. Furthermore, there is no necessity to have the anchoring member 40 (or substitute portions) extending normally to the plate member 38. Finally, it is contemplated that the plate member 38 itself, through suitable roughening, corrugation or analogous treatment, may be made to have a sufficiently strong interlock with the body portion 12 that no need for any anchoring member or substitute portion is present, regardless of the extent of the mechanical interference between the hanger rod and the opening.

It is contemplated that the hanger rods will be molded into the body portion 12 in the orientation represented by the hanger rod 24 in FIG. 1, which also corresponds with the non-interfering relationship between the rod and the opening shown in FIGS. 4 and 7. After compressing and baking the sideboard with the hanger rods thus embedded in the body portion 12, the rods are oscillated or swivelled from side to side (close to the original orientations) in order to "break them loose" from the material of the body portion 12, and to create an elongated cavity or bore within which the individual hanger rods may be slid longitudinally. The hanger rods would then be adjusted to the proper distance, i.e. the parts 28 of the hanger rods would be positioned a desired distance away from the top face 20 of the sideboard 10 (with the hanger rods still in the orientation represented by the hanger rod 24 in FIG. 1), and then, in this desired position, the hanger rods would be swivelled to an orientation in which the parts 28 extend perpendicularly to the main extent of the sideboard, as shown in solid lines for the hanger rod 22 in FIG. 1, and as also shown in FIG. 2. The swivelling from the dotted line position to the solid line position in FIG. 1 would correspond to rotation of the respective hanger rod from the orientation c8 shown in FIG. 4 through 90° to the orientation shown in FIG. 6, during the latter portion of which binding or mechanical interference would have taken place between the hanger rod and the opening, thereby to permit the hanger rods 23, 24 to support the weight of the sideboard 10 inside the ingot mold as best shown in FIG. 2.

It is emphasized again that the specific configurations of the rod and the opening shown in FIGS. 4 – 8 are not essential to this invention. What is essential is that the rod be softer than the material defining the opening, and that the opening have a least dimension which is slightly smaller than the largest dimension across the rod, whereby the rod can be rotated between a position where there is no binding or mechanical interference, and a position where binding and mechanical interference does take place.

Figure 9:
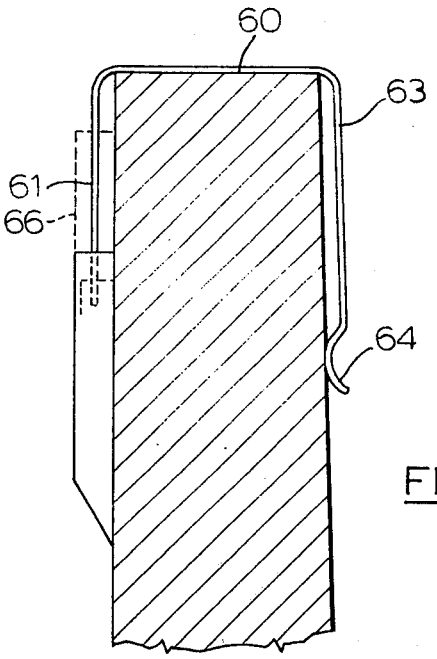
FIG. 9 shows a variant of the rod configuration.

Attention is now directed to FIG. 9, which shows a variation of the configuration of the rod portion not connected with the sideboard. Whereas the FIG. 2 rod configuration includes an end portion 30 which is intended to abut the upper substantially flat surface of an ingot mold 32, the variation shown in FIG. 9 includes a wider and more elongated rod portion which includes a horizontal part 60 attached to the main vertical part 61, and a downwardly extending part 63 terminating in a rounded portion 64. It is intended that the rod be resilient, and that the dimensions of the different parts of the rod shown in FIG. 9 be such that, when the sideboard is hung in supported position inside the ingot mold, the rounded portion 64 will press against the outside of the mold, thus securely drawing the sideboard against the inside wall. For the variation shown in FIG. 9, it is contemplated that the rod would be molded into the sideboard at the time of baking, with the vertical part 61 at its maximum entry into the sideboard. This would mean that the sideboard would be in the location shown by the dotted lines 66 in FIG. 9. Furthermore, the rod would be rotated 90° from the position shown in FIG. 9, and this would mean that the separation between parts 61 and 63 of the rod would have to be great enough to encompass the intervening portion of the sideboard. Finally, it is considered desirable that, with the sideboard at its lowermost hung position (that shown in solid lines in FIG. 9), the rounded portion 64 of the rod should bear against the outside surface of the ingot mold at a vertical location which is in the region of the mid-area of the sideboard. This configuration is desirable in order to ensure that the sideboard will be held firmly against the inside surface of the sideboard mold.

Attention is once more directed to FIG. 1, and particularly to the top face 20 of the body portion 12 of the sideboard 10. As can be seen, there is provided a distance calibrating wire 68 of crenellated configuration, having one end 70 buried downwardly into the body portion 12, and having its major extent lying against and weakly adhered to the top face 20. It is contemplated that the distance calibrating wire 68 be molded in place at the time of the baking of the body portion 12, so that the baking procedure will result in the weak adhesion of the major portion of the distance calibrating wire 68 to the top face 20 of the body portion 12. It is contemplated that each of the crenellations of the distance calibrating wire 68 will be a specific distance apart, for example one inch. In use, the distance calibrating wire 68 would be utilized to ensure that the sideboard 10 is hung a certain known distance below the upper inner corner of the ingot mold 32. The distance calibrating wire 68 would be gripped and pulled upwardly so that it pivots at the location between the end 70 and the major portion lying against the top face 20. This would result in cold-working of the wire, so that the same would remain in its upstanding position once placed in that position. The user could then simply sight by eye to determine the vertical distance between the top edge of the ingot mold 32 and the top of the sideboard 10.

Figure 10:
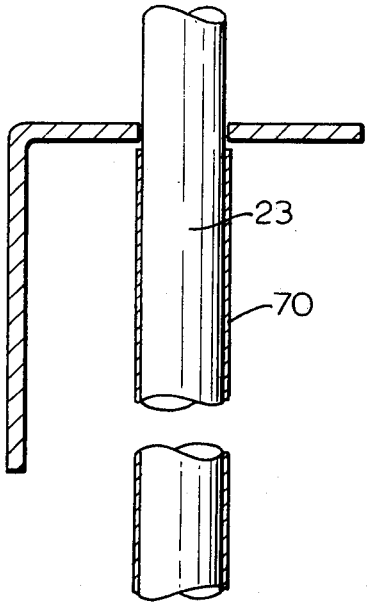
FIG. 10 shows a further variant of construction.

Attention is now directed to FIG. 10, which shows a variation in the rod construction. In FIG. 10, the hanger rod 23 is seen to be wrapped in a surrounding layer 70 of a material which is preferably paper, but which may conveniently be constituted by other materials as well. The purpose of providing the surrounding layer of paper is to reduce the resistance of the rod 23 to the initial rotation intended to "break" the rod away from its baked-in adherence to the material constituting the sideboard 10. Provision of the layer 70 will reduce this adhesion. As can be seen in FIG. 10, the layer 70 may be provided only over the portion of the rod 23 which extends downwardly from the locking element 37.

What I claim is:

1. For use with an open-topped metal ingot mold: a sideboard comprising a body portion, a hanger rod of which part extends through said body portion, and a plate member embedded within the body portion, the plate member being oriented substantially normally to the hanger rod and having a non-circular opening with a least dimension measured in one direction and a greatest dimension measured in another direction, the rod passing through said opening and having a non-circular section at least in the region of said opening, said rod being rotatable within said opening between a first position in which it binds against edge portions of the opening and a second position in which it does not so bind, whereby the rod in said second position can be moved lengthwise through said opening, the material of the rod being softer than the material defining the opening, another part of the rod extending out of the body portion and having means for hanging the sideboard from the ingot mold.

2. The invention claimed in claim 1, in which said section has a smallest dimension measured in one direction and a largest dimension measured in another direction, the largest dimension of said section being slightly greater than said least dimension of the opening.

3. The invention claimed in claim 1, in which both said section and said opening have the general shape of a circle from which two antipodal, identical segments have been removed, thereby providing a shape defined by two straight edges and two arcuate edges, the distance between the two straight edges of the opening being slightly smaller than the diametral distance between the two arcuate edges of the hanger rod section.

4. The invention claimed in claim 1, in which the plate member is attached to an anchoring member which is angled to the plane of the plate member and which is also embedded in said body portion, the anchoring member serving to resist any tendency in the plate member to swivel within the body portion as a result of torque applied thereto through rotation of the hanger rod.

5. The invention claimed in claim 4, in which the anchoring member and the plate member are integral parts of a single metal plate bent to define an L-shape.

6. The invention claimed in claim 1, in which the plate member is of sheet steel with a thickness in the range from about .020 to about .026 in. and a carbon content in the range from about 0.30% to about 0.50%, and in which the hanger rod is also of steel, with a carbon content in the range from about 0.10% to about 0.20%.

7. The invention claimed in claim 2, in which said largest dimension of the non-circular section of the hanger rod is larger than said least dimension of the opening by an amount in the range from about 0.02 in. to about 0.05 in.

8. The invention claimed in claim 7, in which both said section and said opening have the general shape of a circle from which two antipodal, identical segments have beeen removed, thereby providing a shape defined by two straight parallel edges and two arcuate edges, the distance between the two straight edges of the opening being smaller than the diametral distance between the two arcuate edges of the hanger rod section; and in which an anchoring member is attached to the plate member at an angle to the plane of the plate member, the anchoring member being embedded in the body portion and serving to resist any tendency for the plate member to swivel within the body portion as a result of torque applied thereto through rotation of the hanger rod.

9. The invention claimed in claim 8, in which the anchoring member and the plate member are integral parts of a single sheet steel plate bent to define an L-shape, the sheet steel plate having a thickness in the range from about .020 to about .026 and a carbon content in the range from about 0.30% to 0.50%, the hanger rod also being of steel, with a carbon content in the range from about 0.10% to about 0.20%.

10. The invention claimed in claim 1, in which the part of the rod extending out of the body portion has a first portion extending substantially normally to the part of the rod extending through the body portion, and has a second portion arranged in substantial alignment with said part of the rod extending through the body portion, such that the hanger rod is substantially C-shaped, the said second portion having an incurved end portion adapted to bear against the outside of a metal ingot mold.

11. The invention claimed in claim 1, in which the sideboard includes a uniformly crenellated wire weakly adhered to an upper portion thereof, the wire having an end portion embedded in said body portion and being capable of permanent distortion.

12. The invention claimed in claim 1, in which said part of said rod is enwrapped over at least a portion of its length with a layer of paper-like material.

13. A method of providing a sideboard inside an open-topped metal ingot mold, comprising the steps:

manufacturing a sideboard by forming and baking sideboard material with part of a hanger rod embedded therein and with a plate member also embedded therein, the plate member being substantially normal to the hanger rod and having a non-circular opening through which said part of the hanger rod extends, said part having a non-circular section with a largest dimension sufficient to cause binding between the rod and the plate member when the rod is in a given orientation with respect to the plate member, the rod being of a softer material than the plate member and having a further part extending out of the sideboard and angled so as to be capable of catching on the top of an ingot mold and so hanging the sideboard;

oscillating the hanger rod within the sideboard to break it free of the sideboard material and to permit it to be slid longitudinally with respect to the sideboard;

sliding the hanger rod longitudinally to a desired position with the rod in an angular orientation which avoids binding, and rotating the hanger rod to an angular position in which it binds against said plate member and in which said further part extends away from the sideboard, and hanging the sideboard inside the ingot mold.

* * * * *